US008122527B2

(12) United States Patent
Ruttler

(10) Patent No.: US 8,122,527 B2
(45) Date of Patent: Feb. 28, 2012

(54) SHOWER CHAIR DIGNITY MAT

(76) Inventor: Alice Ruttler, Port St. Lucie, FL (US)

( * ) Notice: Subject to any disclaimer, the term of this patent is extended or adjusted under 35 U.S.C. 154(b) by 1083 days.

(21) Appl. No.: 12/008,319

(22) Filed: Jan. 10, 2008

(65) Prior Publication Data

US 2009/0019631 A1 Jan. 22, 2009

Related U.S. Application Data

(63) Continuation-in-part of application No. 11/827,300, filed on Jul. 11, 2007, now abandoned.

(51) Int. Cl.
*A47K 11/06* (2006.01)

(52) U.S. Cl. ..... 4/484; 4/483; 4/578.1; 297/182; 297/188.08

(58) Field of Classification Search ..... 4/480, 460, 4/234, 245.7, 483–484, 578.1; 297/182, 297/188.08, 188.09, 188.1
See application file for complete search history.

(56) References Cited

U.S. PATENT DOCUMENTS 2,700,413 A * 1/1955 Williams ..... 297/182
3,124,387 A * 3/1964 Maclaren ..... 297/16.2
3,950,794 A * 4/1976 Dalton ..... 4/484
4,621,804 A * 11/1986 Mueller ..... 280/87.041
4,800,677 A * 1/1989 Mack ..... 119/171
5,517,704 A 5/1996 Dagostino
5,564,136 A * 10/1996 Cox ..... 4/480
5,608,925 A * 3/1997 Porter ..... 4/480
5,630,376 A * 5/1997 Ochi et al. ..... 119/169
5,704,682 A * 1/1998 Gorayeb et al. ..... 297/5
6,279,178 B1 8/2001 Hill
7,249,570 B1 * 7/2007 Roberson ..... 119/169
7,857,380 B2 * 12/2010 Grieger et al. ..... 297/188.1
2001/0025910 A1 * 10/2001 Olivadoti ..... 248/346.01
2009/0167063 A1 * 7/2009 Brunner ..... 297/16.1

* cited by examiner

*Primary Examiner* — Winnie Yip
(74) *Attorney, Agent, or Firm* — Stephen C. Thomas; Robert A. Lynch; Hayworth, Chaney & Thomas, P.A.

(57) ABSTRACT

A waste collection device suspended below a shower chair for collecting human defecation and other bodily waste before such waste contacts a shower room floor. Due to its function, the mat further provides greater confidence and less anxiety in physically challenged and infirm individuals. The present invention is suspended by a plurality of adjustable support straps which may attach to support structures of any conventional shower chair. Support straps may include upper straps and lower straps that may be used either separately or in combination. A disposable flat collecting material may be held in place atop the upper surface of the mat by holding straps attached along opposing edges of the mat. The present invention serves to eliminate the spread of infection by preventing the shower room floor from becoming contaminated with feces and/or other bodily waste.

6 Claims, 8 Drawing Sheets

SHOWER CHAIR DIGNITY MAT

CROSS REFERENCE TO RELATED APPLICATIONS

This application is a continuation-in-part of Ser. No. 11/827,300, filed with the U.S. Patent and Trademark Office on Jul. 11, 2007 now abandoned, which is herein incorporated by reference in its entirety.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The present invention generally relates to the field of infection control, more specifically, the present invention relates to a sanitary mat suspended below a shower chair seat for collecting human waste before it contacts and contaminates a shower room floor.

2. Background Art

The utility of providing a chair for use by the physically challenged or the infirm while within a bathtub or shower environment has long been known. Many bathtub and shower chairs can be found in the art. However, such prior art devices have one or more drawbacks.

Many prior art devices have limited utility beyond providing the seating function making such devices relatively less versatile. On the other hand, some devices are unusually complex in design making them relatively expensive to build and maintain. Still other bathing chairs are unduly difficult to operate. These chairs may also be intimidating to the targeted users for a variety of reasons when the chairs are used either at home or in an institutional setting.

While in a patient care facility, patients may come into contact with human fecal waste due to improper methods of disposal. In nursing facilities, rehab facilities, and hospitals patients frequently may use conventional shower chairs to help with their fatigue if they are unable to stand long enough to take a shower. While seated in a shower chair a patient may lose control of their bowels and accidentally defecate on the shower room floor. A variety of reasons may cause such an event. For example, a patient may be on antibiotic therapy causing diarrhea or a stroke may cause a patient to lose control of their bowels. With few people realizing the magnitude and impact of this problem, this specific need within the health care industry has not been widely addressed. When a patient accidentally defecates onto the floor while taking a shower, the fecal matter must be removed either by a caregiver using gloves and toilet tissue or the feces may be washed down the shower drain using the shower water stream. The next ambulatory patient may then end up standing in this area of fecal contamination that was not properly sanitized after the previous event, possibly subjecting the ambulatory patient to bacterial infection due to the fecal contamination.

Such a defecation event also involves a dignity issue for both the patient and the caregiver. The patient may become extremely embarrassed because of the defecation and feel the need to apologize for the act. The caregiver may attempt to reassure the patient that they should not be embarrassed or ashamed of the incident. However, the caregiver must still oftentimes manually clean and/or remove the feces from the shower room floor.

Little attention has been given in the prior art to this long standing problem. Many conventional shower chairs, such as U.S. Pat. No. 5,517,704 to Dagostino, may be used to locate a seated patient over a conventional toilet for defecation purposes but provide no means of collecting fecal material in a shower environment. Alternatively, in U.S. Pat. No. 6,279,178 to Hill, a pan may be removably receivable between a pair of flanges in order to act as a toilet pan for a user.

Therefore, there is a longfelt need in the art for a shower chair dignity mat used in a bathtub or shower environment that overcomes the drawbacks found in prior art devices. Such a device must be relatively simple in design and operation and must have a range of adaptability to allow customization and retrofitting of such a device onto the wide variety of conventional shower chairs known within the art. The present invention provides a waste collection device that collects any patient defecation or other bodily waste before it contacts and thereby contaminates a shower room floor. In this manner, the present inventive device serves to prevent the spread of infection while further reducing patient anxiety and simultaneously fostering a greater sense of well being.

BRIEF SUMMARY OF THE INVENTION

In accordance with the present invention, a waste collection device for attachment to a shower chair, the device comprising a mat, a plurality of straps secured to the mat, and securing means disposed on distal ends of the plurality of straps for securing the mat below a seat element of the shower chair.

The waste collection device of the present invention may suspend below the seat of any conventional shower chair to collect and thereby prevent any defecation or other bodily waste from contacting the floor. The stool may be collected on a flat disposable collecting material placed on the mat and thereafter be easily disposed of by removal of the disposable collecting material. Thus, use of such a waste collection device prevents the spread of infection and gives the patient and caregiver a feeling of dignity when such a device is used.

The waste collection device of the present invention provides numerous advantages to a user. Primarily the present invention serves as an infection control device by collecting fallen stool and thereby preventing the stool from contacting and contaminating the floor with fecal matter.

The present invention further prevents fecal waste from being spread to all areas of a shower stall. The spread of fecal waste may occur when the stool is broken apart by a stream of water from the shower head before it is able to be disposed of down the shower drain.

The present invention will prevent fecal waste from entering the body through openings in a patient's feet. Diseases such as diabetes can cause people to become easily infected, slow healers, and cause neuropathy of the lower legs and feet. Neuropathy may cause a patient to have inadequate feeling in their legs and feet. Thus, the patient may have blisters, sores, or open cracked skin on their feet without them knowing. Peripheral vascular disease is another cause of both poor lower leg circulation and numbness in both the hands and feet. Such patients may accidentally hit or cut themselves without even realizing it.

Further, the present invention serves to collect the defecation under the seat of the shower chair before it contacts the floor. This allows a caregiver to remove the stool quickly and easily without physical handling of the stool or having to spray the stool down the shower drain.

Yet further, the present invention gives the patient and the caregiver a greater feeling of dignity to know that there is a protective mat in place to catch any uncontrollable defecation that may occur, and thereby prevents feelings of embarrassment from such uncontrollable defecations and their need to be removed from the shower floor.

Further still, the present invention helps a patient have less anxiety about taking a shower due to any uncontrollable defecation that may occur during their time on the shower chair.

DETAILED DESCRIPTION OF THE INVENTION

Figure 1:
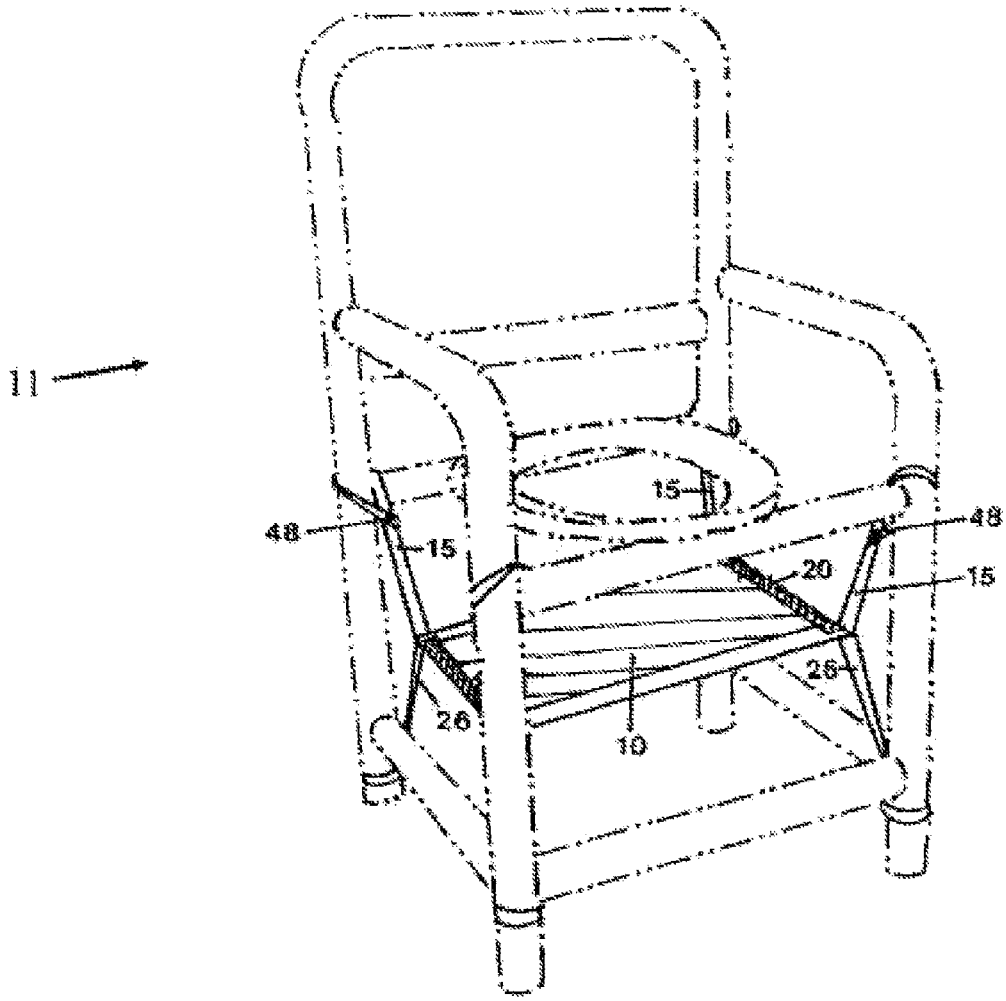
FIG. 1 depicts a perspective view of an embodiment of a waste collection device of the present invention attached to a conventional shower chair (shown as a ghost image).
Figure 2:
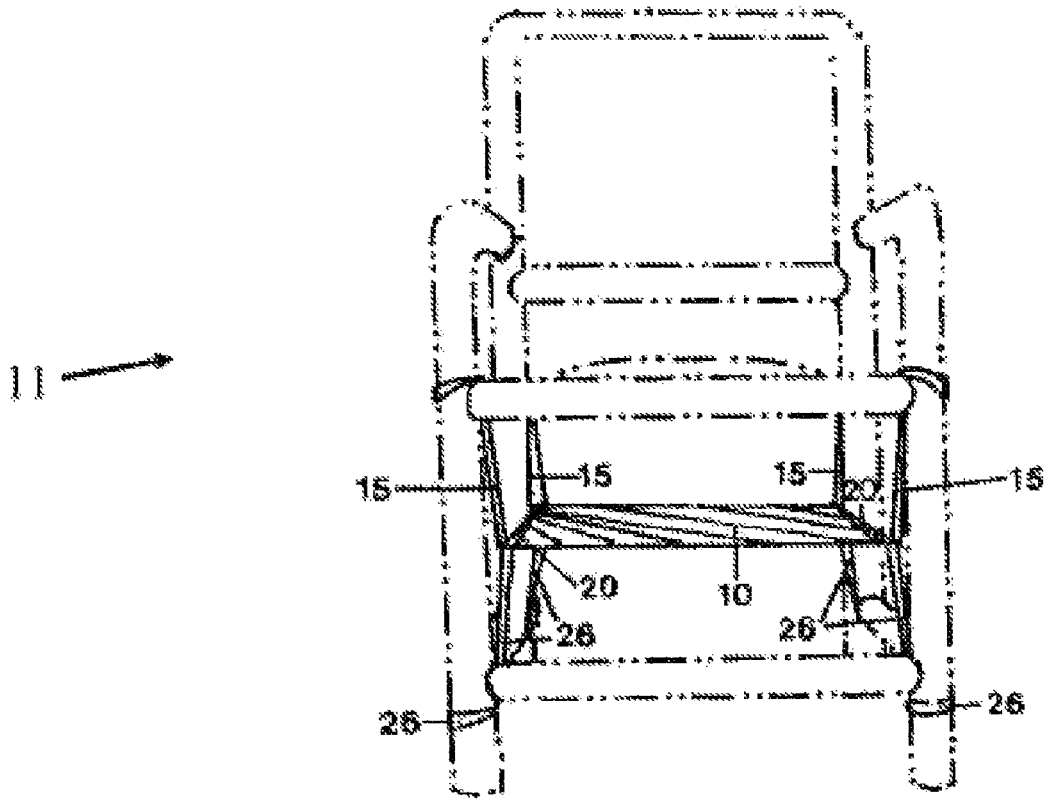
FIG. 2 depicts a front view of an embodiment of the waste collection device of the present invention suspended below a seat element of a conventional shower chair (shown as a ghost image).

FIG. 1 and FIG. 2 depict a preferred embodiment of the present inventive waste collection device 11 attached to a conventional shower chair (shown in ghost image). The waste collection device 11 comprises a mat 10 that may be suspended an appropriate distance below a seat element of the shower chair by four upper straps 15 and four lower straps 26. The mat 10 of the present invention may comprise any materials known within the arts including but not limited to plastic, mesh, hex mesh, leno mesh, vinyl mesh, diamond mesh, vegetation, square mesh, diamondback composite, polyester netting, mesh fabric, leather, denier cordura, upholstery material, nylon upholstery, canvas, poly/cotton blend fabric, polyester fabric, rubber, elastic, polyurethane material, aluminum, wire, and the like.

A first end of each upper strap 15 may be held in place about a structure of a conventional shower chair by means of a first securing means 48. A second end of each upper strap 15 may be fixedly attached to the mat 10, preferably at a corner of the mat 10. Similarly, a first end of each lower strap 26 may be held in place about a structure of a conventional shower chair by means of a second securing means 30. A second end of each lower strap 26 may be fixedly attached to the mat 10, preferably at a corner of the mat 10. Alternatively, the respective straps 15,26 may have securing means 48,30 at both ends of each strap 15,26 wherein the central body portion of each strap 15,26 is disposed along and may be attached to a peripheral edge of the mat 10 (as depicted in the cross sections of FIG. 3B, FIG. 4B and FIG. 5B). The first securing means 48 and the second securing means 30 disposed on the first end of the upper straps 15 and lower straps 26, respectively, may allow for size adjustment of the respective securing means so as to be able to accommodate retrofitting the device 11 onto the various sizes and shapes of conventional shower chairs known within the art.

Each respective strap of both the upper straps 15 and lower straps 26 may comprise any materials known within the arts including but not limited to elastic, fabric elastic, knitted elastic, braided elastic, woven elastic, ball chain, chain, ribbon, rope, lace cord, string, twine, wire, plastic, piping, wood, leather, cowhide, vinyl, tubing, plastic tubing, latex tubing, tourniquet, fiberglass, webbing, cotton webbing, polyester webbing, polypropylene webbing, multifilament polypropylene, and the like.

Additionally, each respective securing means of the first securing means 48 and the second securing means 30 may comprises any securing structure known within the art including but not limited to buttons, hook and loop fasteners (e.g. Velcro®), D-rings, O-rings, S-hooks, triglides, toggles, snap hooks, snap fasteners, lanyard hooks, loops, plastic loops, metal loops, knots, bows, clamps, magnets, brackets, safety pins, strap adjusters, plastic keepers, garters, sew on ratchet, jaw clips, sling clips, grommets and washers, slides, gauge wires, rectangular gauge wires, hooks with removable bars, quick webs, buckles, slide buckles, snap-to-close buckles, push-button buckles, vest buckles with teeth, vest buckles without teeth, side release buckles, cam buckles, center-release buckles, web strap buckles, ladder locks, cinch locks, acetyl plastic cord locks, and the like.

Holding straps 20 may be utilized to hold a flat disposable collecting material (not shown) on the upper surface of the mat 10. The holding straps 20 may be disposed along opposing edges of the mat 10, as depicted in FIG. 1. The ends of each holding strap 20 may then be attached to the mat 10 and/or the respective straps 15,26 at the corners of the mat 10. Such a configuration provides an open slit on opposite sides of the mat 10 below each holding strap 20 for releasably retaining the edges of the flat disposable collecting material. Depending on the layering configuration of the elements of the present inventive device 11, the open slit may be between the holding strap 20 and the immediately adjacent layer there below. In use, the holding straps 20 may be disposed along the front and rear edges of the mat 10 and/or along both lateral edges of the mat 10. After defecation, the flat disposable collecting material may then be easily released from under the holding straps 20, gathered from atop the mat 10, and thrown into a proper disposal container.

The disposable collecting material may comprise any materials known within the arts including but not limited to non-woven material, woven material, biodegradable material, flushable material, biodegradable and flushable material, paper, fabric, plastic, crept paper, glazed smooth paper, spun lace, viscon polyester non-woven material, scrim reinforced material, embossed tissue paper, cellulose fibers with adhesive binder, spun bonded non-woven materials, paper liners, and the like.

Figure 3A:
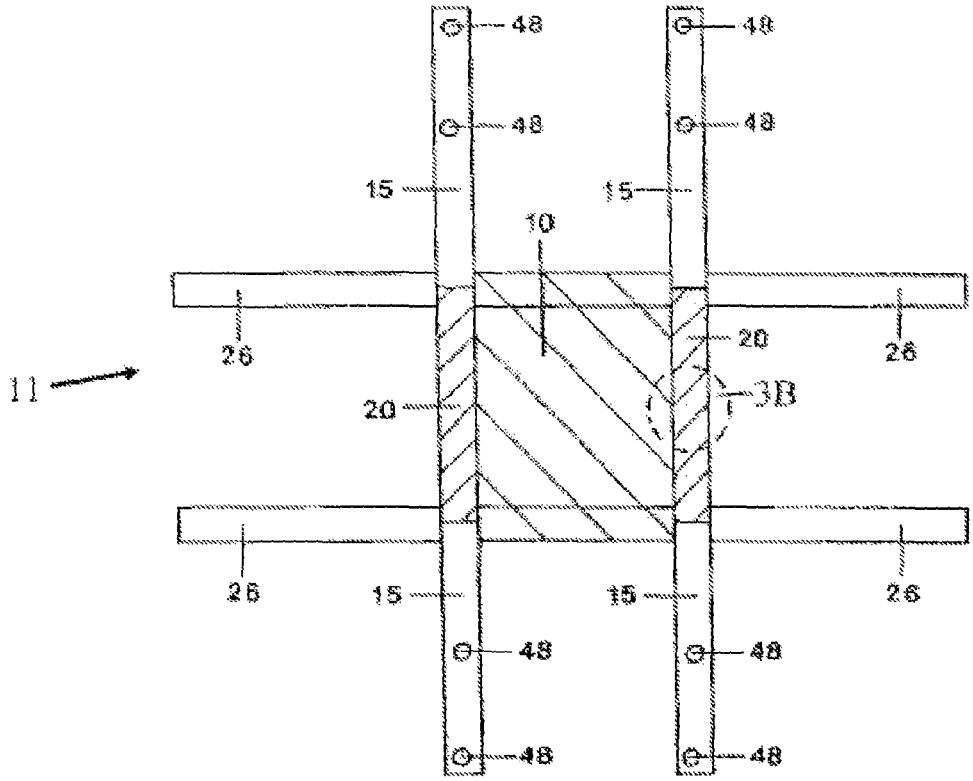
FIG. 3A depicts a top planar view of an embodiment of a first securing means disposed on the upper straps of the waste collection device of the present invention.

FIG. 3A depicts a top planar view of an embodiment showing further detail of the upper straps 15 of the waste collection device 11 of the present invention. The upper straps 15 may be secured around an upper support structure of the shower chair via the first securing means 48 (see FIGS. 1 and 2). As depicted, the first securing means 48 may preferably take the form of snap fasteners 48 placed on the ends of each of the upper straps 15. Proper positioning of the first securing means 48 acts to suspend the mat 10 an appropriate distance below the seat element of the shower chair thereby preventing any feces from coming into contact with the patient. Holding straps 20 may further be used to releasably retain the flat disposable collecting material onto the upper surface of the mat 10. As described above, two holding straps 20 may be disposed over opposing edges of the mat 10, where the holding straps 20 may be attached to the mat 10 at its respective corners.

Figure 3B:
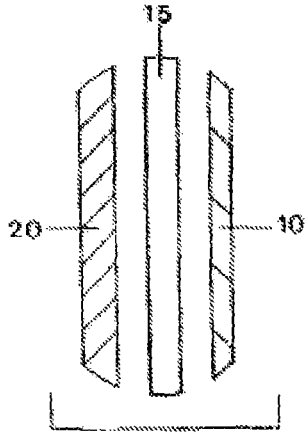
FIG. 3B depicts a cross sectional view of an embodiment of material layering of the waste collection device of the present invention.
Figure 3C:
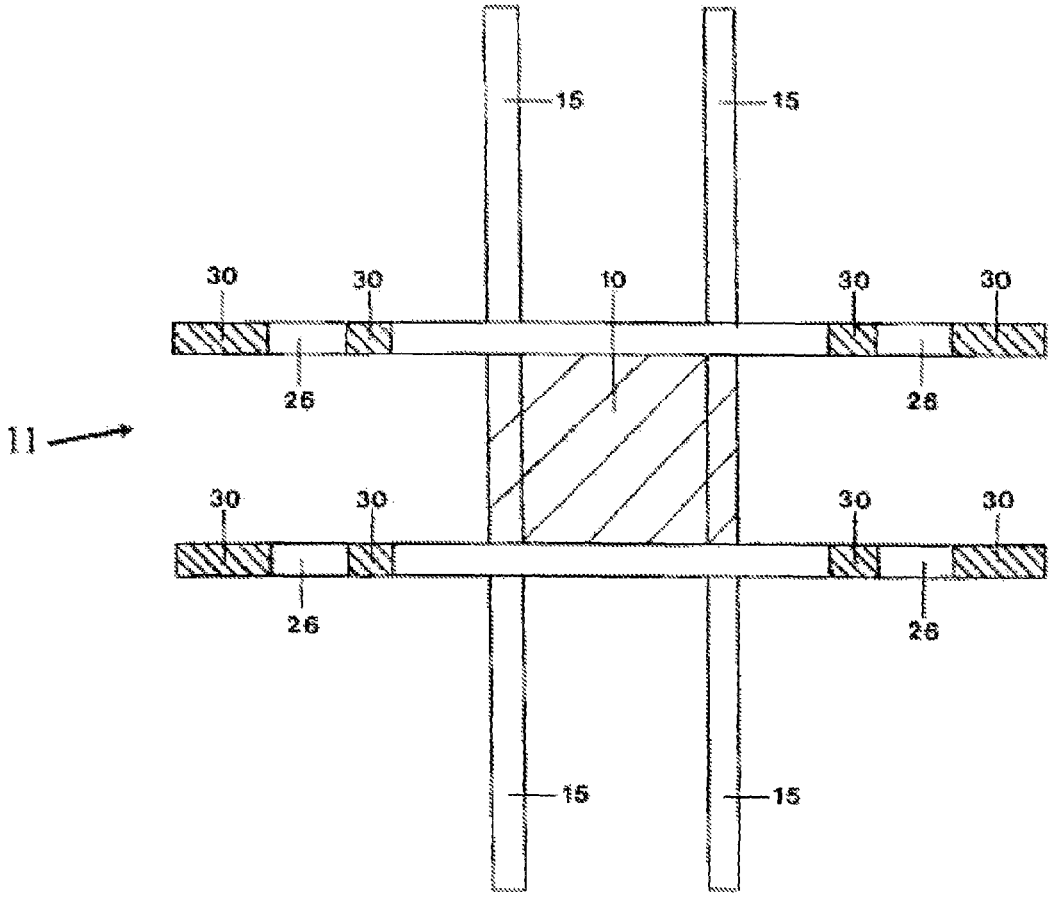
FIG. 3C depicts a bottom planar view of an embodiment of a second securing means disposed on the lower straps of the waste collection device of the present invention.

FIG. 3C depicts a bottom planar view of an embodiment showing further detail of the lower straps 26 of the waste collection device 11 of the present invention. The lower straps 26 may be longer than the upper straps 15 to allow adjustable compensation for the different heights and widths of many conventional shower chairs in the art. The lower straps 26 may be secured around a lower support structure of the shower chair via a second securing means 30, preferably hook and look fasteners (e.g. Velcro®) (see FIGS. 1 and 2). Such an embodiment of the second securing means 30 allows for an adjustable snug fit on all shapes and sizes of conventional shower chairs. At each corner of the mat 10 the upper straps 15 and the lower straps 26 may separate allowing the straps to be respectively attached to the upper and lower support structures of any conventional shower chair.

FIG. 3B depicts a cross sectional view of an embodiment of material layering of a waste collection device 11 of the present invention. The layered elements at the cross sectional location of FIG. 3B comprise the holding strap 20, the upper strap 15, and the mat 10. The layers may be interchanged within the scope of the invention, wherein the holding strap 20 may be fixedly attached at the corners of the mat 10 providing an open slit between the holding strap 20 and any one of the remaining elements for releasably securing the disposable collecting material.

In use, a preferred embodiment of the waste collection device 11 of the present invention may have eight straps, one upper strap 15 and one lower strap 26 being disposed at each corner of a preferably rectangular mat 10. The upper straps 15 may first be wrapped around an upper support structure of the conventional shower chair, with the first securing means 48 securing each upper strap 15 in place. Next, the lower straps 26 may then be wrapped around a lower support structure of the conventional shower chair, with the lower straps 26 held in place by the second securing means 30. A flat disposable collecting material may then be laid out on the mat 10 allowing the edges of the flat disposable collecting material to be releasably retained under the holding straps 20 that are disposed along two opposing edges of the mat 10. When a patient defecates onto the disposable collecting material, a caregiver may then quickly and easily remove the disposable collecting material from the upper surface of the mat 10 and properly disposed of the fecal material. A clean disposable collecting material may then be reapplied over the mat 10 in preparation for any subsequent defecation. The present invention and its method of use prevent human waste from contacting the shower room floor and thereby eliminate such a means of spreading infection.

Figure 4A:
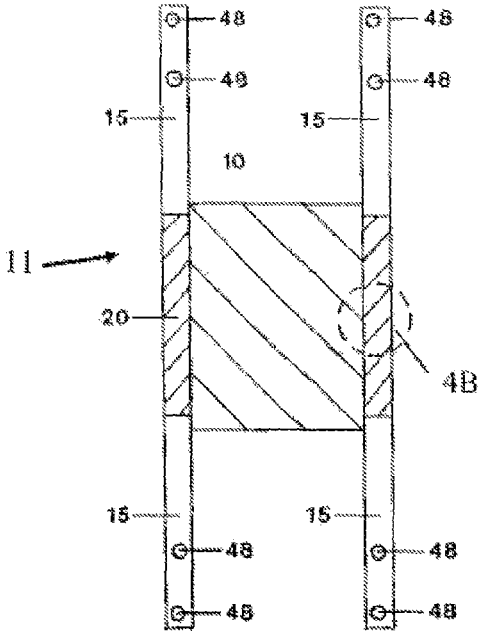
FIG. 4A depicts a top planar view of another embodiment of the waste collection device of the present invention having first securing means disposed on the upper straps.
Figure 4C:
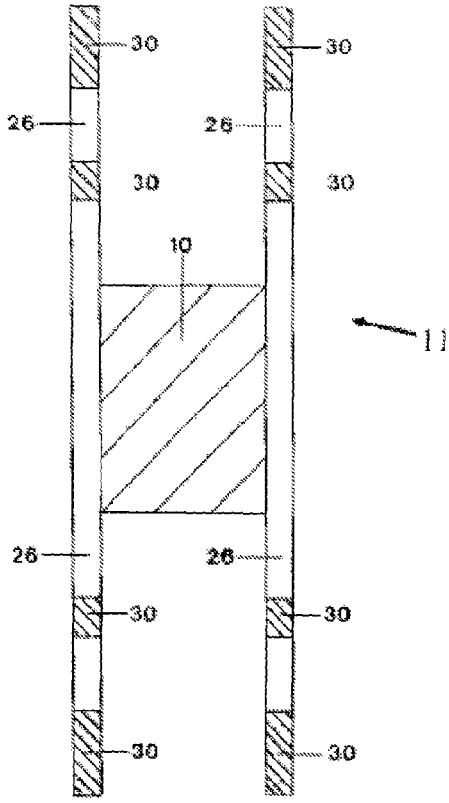
FIG. 4C depicts a bottom planar view of another embodiment of the waste collection device of the present invention having second securing means disposed on the lower straps.

FIG. 4A depicts a top planar view of another embodiment showing further detail of the upper straps 15 of the waste collection device 11 of the present invention. Each upper strap 15 may be secured around an upper support structure of the shower chair using first securing means 48, such as snap fasteners, to assure that the mat 10 is disposed an appropriate distance below the seat element of the shower chair. The respective ends of each holding strap 20 may be attached to the upper straps 15 at the corners of opposite sides of the mat 10. FIG. 4C depicts the lower straps 26 being longer than the upper straps 15. Each lower strap 26 may have a second securing means 30, such as hook and loop fasteners, on their respective distal ends providing for adjustability and enabling the present invention to fit any conventional shower chair.

Figure 4B:
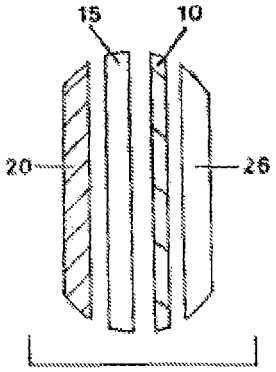
FIG. 4B depicts a cross sectional view of another embodiment of material layering of the waste collection device of the present invention.

FIG. 4B depicts a cross sectional view of another embodiment of material layering of a waste collection device 11 of the present invention. The layered elements at the cross sectional location comprises the holding strap 20, the upper strap 15, the mat 10, and the lower strap 26. At each corner of the mat 10 the straps may separate to allow the straps to attach to support structures of the shower chair. The layers may be interchanged within the scope of the invention, wherein the holding strap 20 may be fixedly attached to any lower layer at the corners of the mat 10 providing an open slit between the holding strap 20 and the layer disposed there below for releasably retaining the disposable collecting material therein.

Figure 6:
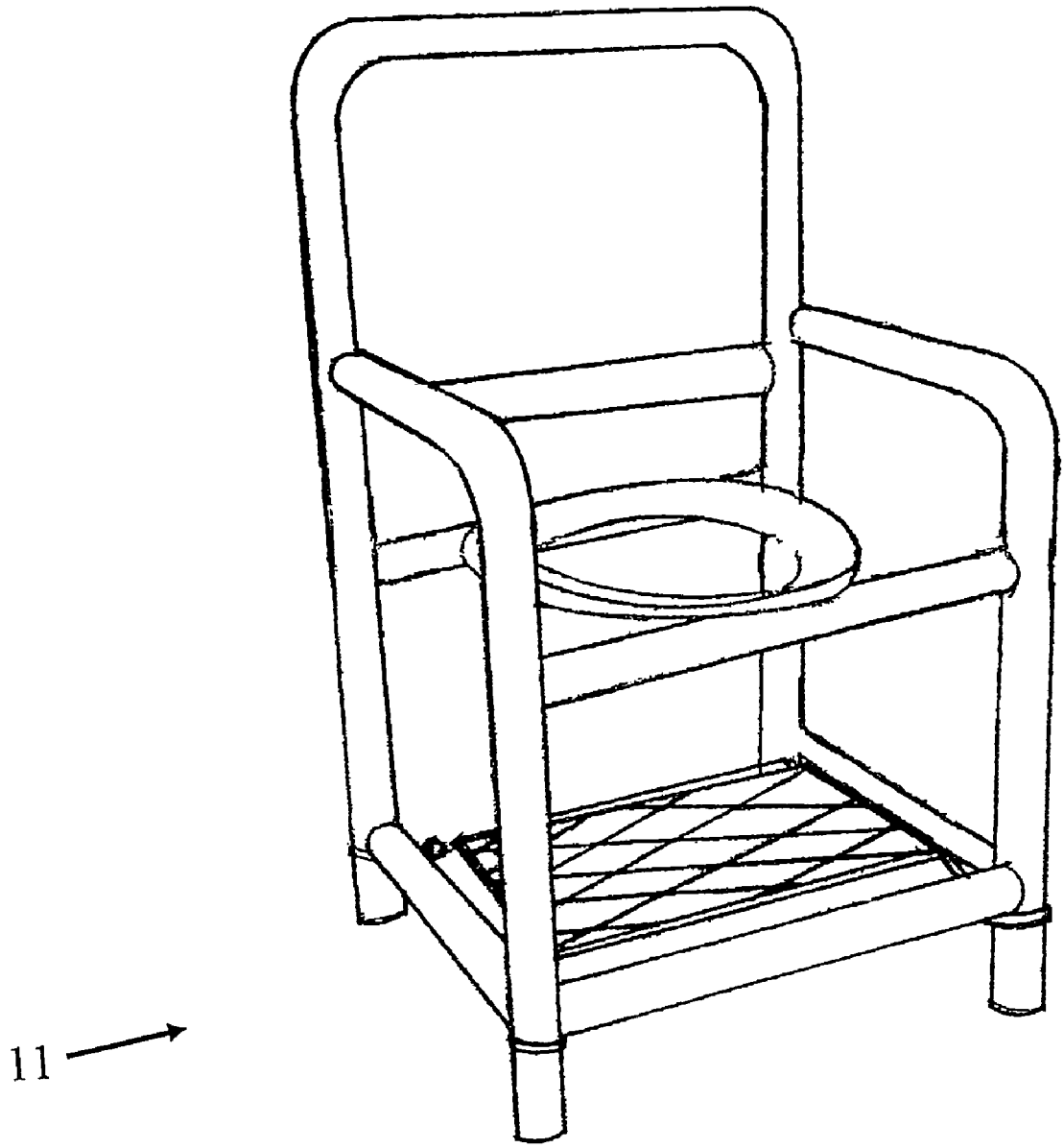
FIG. 6 depicts a perspective view of another embodiment of a waste collection device of the present invention attached to a conventional shower chair.

FIG. 4A and FIG. 4C may be seen to depict embodiments of the present invention requiring only four attachment straps, shown as four upper straps 15 in FIG. 4A or four lower straps 26 in FIG. 4C (see also FIG. 6). Such a reduction in elements of the inventive device further simplifies its attachment to a conventional shower chair and reduces the cost of device 11 manufacture. Alternatively, as depicted in FIG. 4B, the upper straps 15 and lower straps 26 of the device may overlay each other; as opposed to being disposed at right angles to each other (see FIG. 3A and FIG. 3C). In such an embodiment, the top planar view of FIG. 4A would further contain lower straps 26 disposed beneath the upper straps 15 which would continue to extend out from and beyond (not shown) the distal ends of the upper straps 15.

Figure 5A:
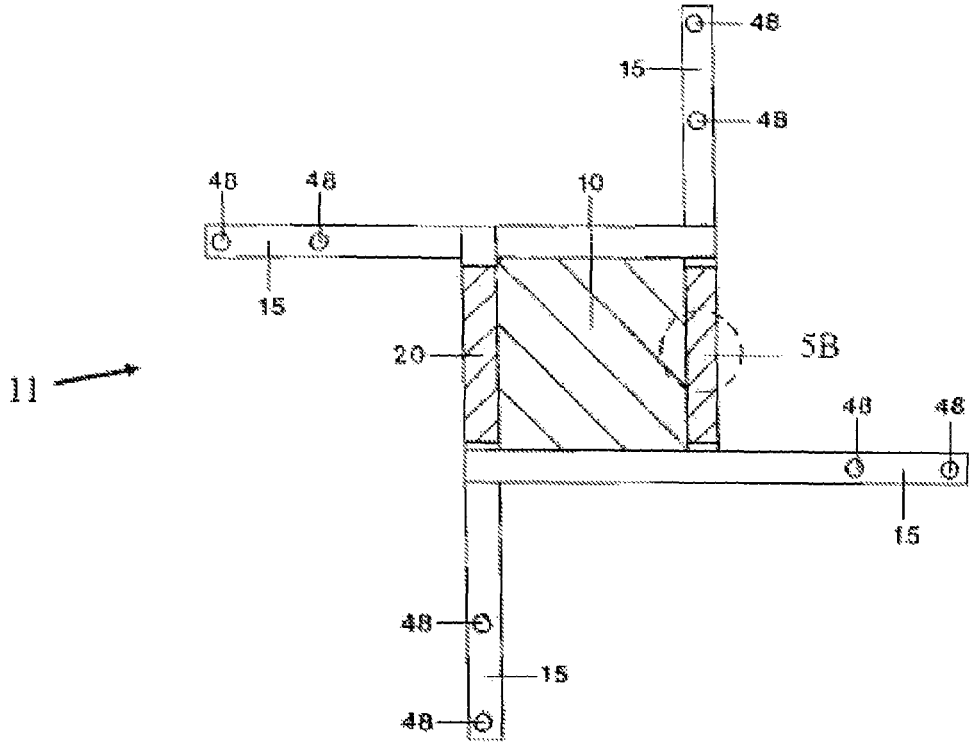
FIG. 5A depicts a top planar view of a further embodiment of the waste collection device of the present invention having first securing means disposed on the upper straps.

FIG. 5A depicts a top planar view of yet another embodiment showing further detail of the upper straps 15 of the waste collection device 11 of the present invention. Each of the four depicted upper straps 15 are disposed along their own unique edge of the mat 10 with the upper straps 15 extending beyond the corners of the mat to provide attachment to a conventional shower chair. Each upper strap 15 may be secured about an upper support structure of a shower chair by a first securing means 48, such as snap fasteners, to assure the mat 10 is disposed an appropriate distance below the seat element of the shower chair. The respective ends of each holding strap 20 may be attached to the upper straps 15 at the corners of opposite sides of the mat 10. FIG. 5C depicts a bottom planar view of lower straps 26 that are longer than the upper straps 15. Each lower strap 26 may have a second securing means 30, such as hook and loop fasteners, on their respective distal ends providing for adjustability and enabling the present invention to fit any conventional shower chair.

Figure 5B:
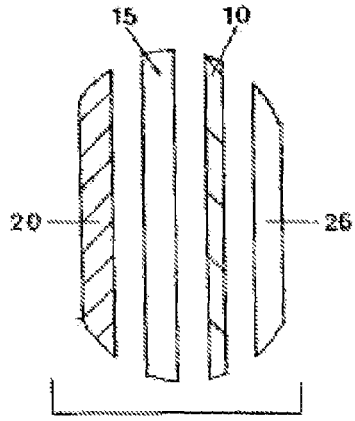
FIG. 5B depicts a cross sectional view of a further embodiment of material layering of the waste collection device of the present invention.
Figure 5C:
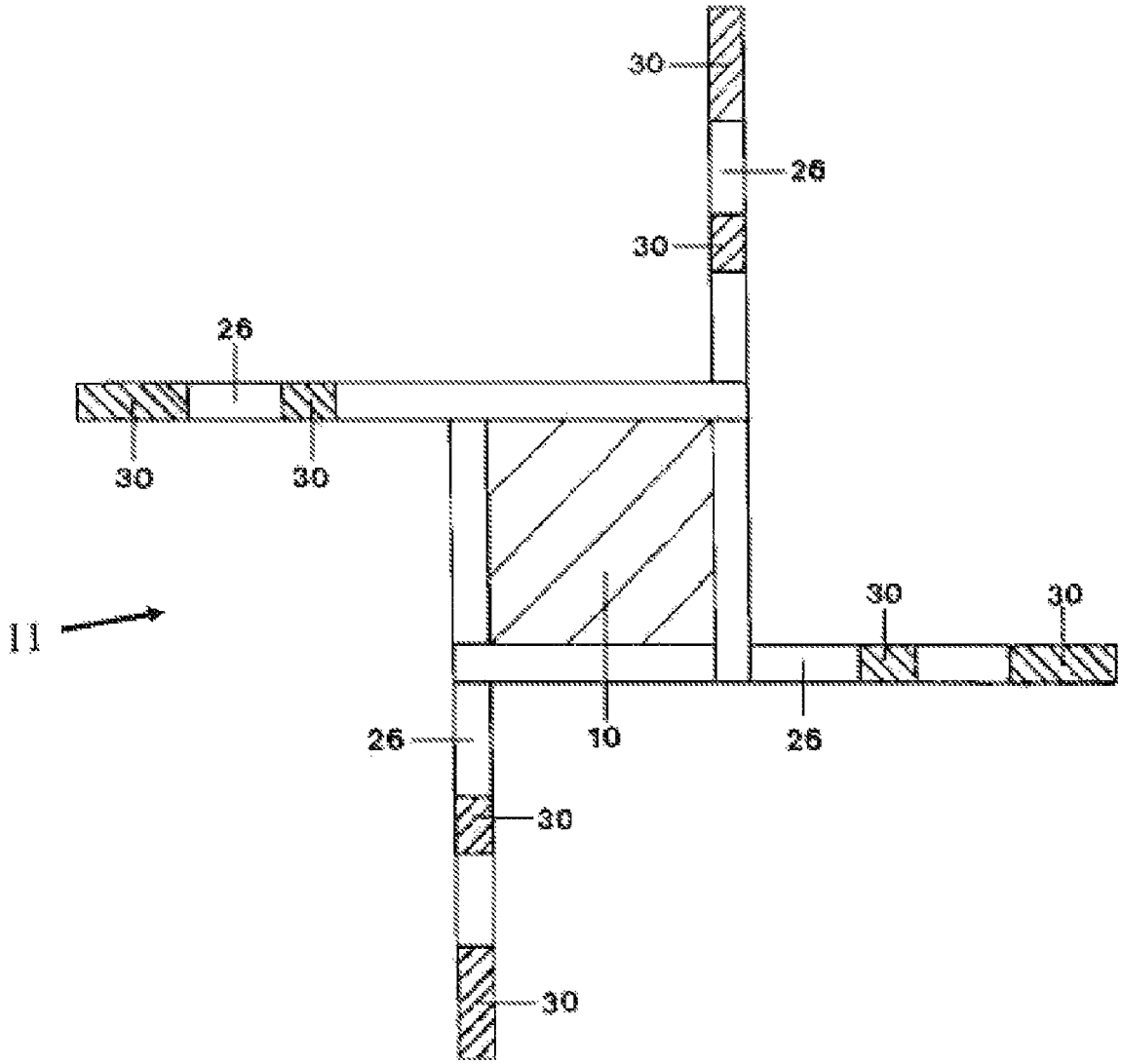
FIG. 5C depicts a bottom planar view of a further embodiment of the waste collection device of the present invention having second securing means disposed on the lower straps.

FIG. 5B depicts a cross sectional view of another embodiment of material layering of a waste collection device 11 of the present invention. The layered elements at the cross sectional location comprises the holding strap 20, the upper strap 15, the mat 10, and the lower strap 26. At each corner of the mat 10 the straps 15,26 may separate allowing the straps 15,26 to attach to respective support structures of the shower chair. The layers may be interchanged within the scope of the invention, wherein the holding strap 20 may be fixedly attached at the corners of the mat 10 providing an open slit between the holding strap 20 and any one of the remaining elements disposed there below for releasably retaining the disposable collecting material.

FIG. 5A and FIG. 5C may be seen to depict embodiments of the present invention requiring only four attachment straps, shown as four upper straps 15 in FIG. 5A or four lower straps 26 in FIG. 5C (see also FIG. 6). Such a reduction in elements of the inventive device further simplifies its attachment to conventional shower chairs and reduces the cost of device 11 manufacture. Alternatively, as depicted in FIG. 5B, the upper straps 15 and lower straps 26 of the device may overlay each other; as opposed to being disposed at right angles to each other (see FIG. 3A and FIG. 3C). In such an embodiment, the top planar view of FIG. 5A would further contain lower straps 26 disposed beneath the upper straps 15 which would continue to extend out from and beyond (not shown) the distal ends of the upper straps 15.

Angles of attachment for both the upper straps 15 and lower straps 26 to the mat 10 have been depicted as being parallel and/or perpendicular to respective side edges of the mat 10 (see FIG. 3A, FIG. 4A, and FIG. 5A). The scope of the present invention further includes any and all oblique angles of attachment for straps 15,26 in reference to the side edges of the mat 10. When upper straps 15 and lower straps 26 are used in combination, their angles of attachment to the mat 10 may be completely independent of each other. If such angles of attachment are equal, the upper straps 15 and lower straps 26 may be disposed in an overlaying configuration. Additionally, the point of attachment of the strap 15,26 to the mat 10 need not be restricted to only the corners of the mat, but may also attach at any given point along the edges of the mat 10. The waste collection device 11 of the present invention may be attached to a conventional shower chair by a plurality of straps, preferably being attached by a combination of two to eight attachment straps 15,26. As discussed above, the present invention may utilize only upper straps 15, only lower straps 26 (see FIG. 6), or both upper straps 15 and lower straps 26 in combination.

From the description above, a wide variety of advantages pertaining to the waste collection device 11 of the present invention are clearly evident. The present inventive waste collection device 11 prevents the spread of disease from an unsanitary shower room floor, offers a quick and controlled means for disposal of collected human waste, and easily attaches to any conventional shower chair known within in the art.

Accordingly, the waste collection device 11 of the present invention may be used as an infection control device as well as a means of retaining patient dignity and a greater sense of well being. With patient excrement never contacting the shower room floor, the spread of infection is eliminated. Yet further, positive psychological benefits will be generated in both the patient and caregiver with each knowing that an inventive barrier is in place to collect and allow easy removal of any defecation that may occur during the showering process. In this manner a patient using the waste collection device 11 of the present invention is saved a great deal of personal embarrassment by a caregiver not having to clean feces from the shower room floor while in the patient's presence. Additionally, the caregiver also may realize a better sense of self worth in not having to manually clean human feces from a shower room floor.

While the above description contains much specificity, these should not be construed as limitations on the scope of any embodiment, but as exemplifications of the presently preferred embodiments thereof. Many other ramifications and variations are possible within the teachings of the various embodiments. The scope of the present invention readily includes any alternative materials, attachment means, supports, size adjustment means, colors, and the like known within the art.

Thus the scope of the invention should be determined by the appended claims and their legal equivalents, and not by the examples given.

What is claimed is:

1. A waste collection device with a shower chair, said device comprising:
   - a mat capable of preventing only human stool from passing through said waste collection device and contacting the surface beneath said shower chair;
   - a plurality of straps secured to said mat;
   - securing means disposed on the distal end of each of said plurality of straps for securing said mat below a seat element of said shower chair;
   - a disposable collecting material disposed on an upper surface of said mat for collecting and allowing quick removal of said human stool, wherein said disposable collecting material is capable of preventing said human stool from passing through said waste collection device and contacting said surface beneath said shower chair; and
   - a plurality of holding straps disposed on said upper surface of said mat for releasably retaining said disposable collecting material beneath said plurality of holding straps and above said mat.

2. The waste collection device of claim 1, wherein said plurality of straps comprises at least two upper straps for attachment to upper support structures of said shower chair and at least two lower straps for attachment to lower support structures of said shower chair.

3. The waste collection device of claim 1, wherein said plurality of straps attaches to said mat at the corners of said mat.

4. The waste collection device of claim 1, wherein said plurality of straps attaches to said mat along the peripheral edges of said mat.

5. The waste collection device of claim 1, wherein said securing means are selected from the group consisting of snap fasteners and hook and loop fasteners.

6. A waste collection device with a shower chair, said device comprising:
   - a mat capable of preventing only human stool from passing through said waste collection device and contacting the surface beneath said shower chair,
   - wherein said mat is composed of material selected from the group consisting of mesh and netting;
   - a plurality of straps secured to said mat, said plurality of straps comprising at least two upper straps for attachment to upper support structures of said shower chair and at least two lower straps for attachment to lower support structures of said shower chair, wherein said plurality of straps attaches to said mat at a position selected from the group consisting of the corners of said mat and the peripheral edges of said mat;
   - securing means disposed on the distal end of each of said plurality of straps for securing said mat below a seat element of said shower chair, wherein said securing means are selected from the group consisting of snap fasteners and hook and loop fasteners;

a disposable collecting material disposed on an upper surface of said mat for collecting and allowing quick removal of said human stool, wherein said disposable collecting material is capable of preventing said human stool from passing through said waste collection device and contacting said surface beneath said shower chair; and a plurality of holding straps disposed on said upper surface of said mat for releasably retaining said disposable collecting material beneath said plurality of holding straps and above said mat, wherein said plurality of holding straps comprise at least two holding straps disposed along opposing edges of said mat, said at least two holding straps being secured to said mat at the corners of said mat.

* * * * *